US007938348B2

(12) United States Patent
Evans et al.

(10) Patent No.: US 7,938,348 B2
(45) Date of Patent: May 10, 2011

(54) LOOSEFILL BLOWING MACHINE WITH A CHUTE

(75) Inventors: Michael E. Evans, Granville, OH (US); Agustin Hernandez, Blacklick, OH (US); Michael W. Johnson, Lithopolis, OH (US); Robert J. O'Leary, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 290 days.

(21) Appl. No.: 11/452,554

(22) Filed: Jun. 14, 2006

(65) Prior Publication Data

US 2006/0231651 A1 Oct. 19, 2006

Related U.S. Application Data

(63) Continuation-in-part of application No. 11/141,653, filed on Aug. 1, 2005, now abandoned, which is a continuation-in-part of application No. 10/899,909, filed on Jul. 27, 2004.

(51) Int. Cl.
*B02C 23/20* (2006.01)
*B02C 23/02* (2006.01)

(52) U.S. Cl. ..... 241/60; 241/225; 241/605

(58) Field of Classification Search ..... 241/60, 241/101.78, 277, 605, 18, 224, 166, 167; 239/379, 345

See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,718,507 | A | 6/1929 | Wenzel et al. |
| 1,811,898 | A | 6/1931 | Schur et al. |
| 2,049,063 | A | 7/1936 | Hubbard |
| 2,057,121 | A | 10/1936 | Trevellyan |
| 2,057,122 | A | 10/1936 | Trevellyan |
| 2,193,849 | A | 3/1940 | Whitfield |
| 2,200,713 | A | 5/1940 | Ericson et al. |
| 2,235,542 | A | 3/1941 | Wenzel |
| 2,262,094 | A | 11/1941 | Burt |
| 2,273,962 | A | 2/1942 | Hubbard |
| 2,291,871 | A | 8/1942 | Bokum et al. |
| 2,308,197 | A | 1/1943 | Meyer |
| 2,311,773 | A | 2/1943 | Patterson |

(Continued)

FOREIGN PATENT DOCUMENTS

| | | |
|---|---|---|
| DE | 3238492 | 4/1984 |

(Continued)

OTHER PUBLICATIONS

U.S. Appl. No. 10/899,909—Advisory Action May 26, 2009.

(Continued)

*Primary Examiner* — Debra M Sullivan
(74) *Attorney, Agent, or Firm* — MacMillan, Sobanski & Todd, LLC

(57) ABSTRACT

A machine for distributing blowing wool from a bag of compressed blowing wool includes a chute having an inlet end and an outlet end, the chute configured to receive the bag of compressed blowing wool. A shredder is mounted at the outlet end of the chute and configured to shred and pick apart the blowing wool. A discharge mechanism distributes the blowing wool into an airstream. The chute is configured such that the minimum length of the chute from the inlet end to the outlet end is the nominal length of a person's arm.

16 Claims, 12 Drawing Sheets

U.S. PATENT DOCUMENTS 2,355,358 A 8/1944 Anderson
2,404,678 A 7/1946 Erb
2,437,831 A 3/1948 Moore
2,532,318 A 12/1950 Mackey et al.
2,532,351 A 12/1950 Wedebrock
2,550,354 A 4/1951 Jacobsen
2,618,817 A 11/1952 Slayter
2,721,767 A 10/1955 Kropp
2,754,995 A 7/1956 Switzer
2,794,454 A 6/1957 Moulthrop
2,869,793 A * 1/1959 Montgomery ..... 241/50
2,938,651 A 5/1960 Specht et al.
2,964,896 A * 12/1960 Finocchiaro ..... 56/157
2,984,872 A 5/1961 France
2,989,252 A 6/1961 Babb
3,051,398 A * 8/1962 Babb ..... 241/136
3,076,659 A 2/1963 Kremer
3,175,866 A 3/1965 Nichol
3,201,007 A 8/1965 Transeau
3,231,105 A 1/1966 Easley
3,278,013 A 10/1966 Banks
3,314,732 A 4/1967 Hagan
3,399,931 A 9/1968 Vogt
3,403,942 A 10/1968 Farnworth
3,485,345 A 12/1969 Deasy
3,512,345 A 5/1970 Smith
3,556,355 A 1/1971 Ruiz
3,591,444 A 7/1971 Hoppe et al.
3,703,970 A 11/1972 Benson
3,747,743 A 7/1973 Hoffmann, Jr.
3,861,599 A 1/1975 Waggoner
3,869,337 A 3/1975 Hoppe et al.
3,895,745 A 7/1975 Hook
3,952,757 A 4/1976 Huey
3,995,775 A 12/1976 Birkmeier et al.
4,059,205 A 11/1977 Heyl
4,129,338 A 12/1978 Mudgett
4,133,542 A 1/1979 Janian et al.
4,134,508 A * 1/1979 Burdett, Jr. ..... 414/810
4,155,486 A 5/1979 Brown
4,179,043 A 12/1979 Fischer
4,180,188 A 12/1979 Anouma et al.
4,236,654 A 12/1980 Mello
4,268,205 A 5/1981 Vacca et al.
4,273,296 A 6/1981 Hoshall et al.
4,337,902 A * 7/1982 Markham ..... 241/56
4,344,580 A 8/1982 Hoshall et al.
4,346,140 A 8/1982 Carlson et al.
4,365,762 A 12/1982 Hoshall
4,381,082 A 4/1983 Elliott et al.
4,411,390 A 10/1983 Woten
4,465,239 A 8/1984 Woten
4,536,121 A 8/1985 Stewart et al.
4,537,333 A 8/1985 Bjerregaard
4,560,307 A 12/1985 Deitesfeld
4,585,239 A 4/1986 Nicholson
4,640,082 A 2/1987 Gill
4,695,501 A 9/1987 Robinson
4,716,712 A 1/1988 Gill
4,784,298 A 11/1988 Heep et al.
4,880,150 A 11/1989 Navin et al.
4,915,265 A 4/1990 Heep et al.
4,919,403 A 4/1990 Bartholomew
4,978,252 A 12/1990 Sperber
5,014,885 A 5/1991 Heep et al.
5,037,014 A 8/1991 Bliss
5,052,288 A 10/1991 Marquez et al.
5,129,554 A 7/1992 Futamura
5,156,499 A 10/1992 Miklich
5,166,236 A 11/1992 Alexander et al.
5,289,982 A 3/1994 Andersen
5,303,672 A 4/1994 Morris
5,323,819 A 6/1994 Shade
5,368,311 A 11/1994 Heyl
5,380,094 A 1/1995 Schmidt et al.
5,392,964 A 2/1995 Stapp et al.
5,462,238 A 10/1995 Smith et al.
5,472,305 A 12/1995 Ikeda et al.
5,511,730 A 4/1996 Miller et al.
5,601,239 A 2/1997 Smith et al.
5,620,116 A 4/1997 Kluger et al.
5,624,742 A 4/1997 Babbitt et al.
5,639,033 A 6/1997 Miller et al.
5,642,601 A 7/1997 Thompson, Jr. et al.
5,647,696 A 7/1997 Sperber
5,683,810 A 11/1997 Babbitt et al.
5,819,991 A 10/1998 Kohn et al.
5,829,649 A 11/1998 Horton
5,860,232 A 1/1999 Nathenson et al.
5,860,606 A 1/1999 Tiedeman et al.
5,927,558 A 7/1999 Bruce
5,934,809 A 8/1999 Marbler
5,987,833 A 11/1999 Heffelfinger et al.
5,997,220 A 12/1999 Wormser
6,004,023 A * 12/1999 Koyanagi et al. ..... 366/17
6,036,060 A 3/2000 Munsch et al.
6,070,814 A 6/2000 Deitesfeld
6,074,795 A 6/2000 Watanabe et al.
6,109,488 A * 8/2000 Horton ..... 222/636
6,161,784 A 12/2000 Horton
6,209,724 B1 4/2001 Miller
6,266,843 B1 7/2001 Doman et al.
6,296,424 B1 10/2001 Eckel et al.
6,312,207 B1 11/2001 Rautiainen
6,503,026 B1 1/2003 Mitchell
6,510,945 B1 1/2003 Allwein et al.
6,648,022 B2 11/2003 Pentz et al.
6,698,458 B1 3/2004 Sollars
6,779,691 B2 8/2004 Cheng
6,783,154 B2 8/2004 Persson et al.
6,796,748 B1 9/2004 Sperber
6,826,991 B1 12/2004 Rasmussen
7,266,936 B2 * 9/2007 Wingert ..... 53/438
7,284,715 B2 10/2007 Dziesinski et al.
7,354,466 B2 4/2008 Dunning et al.
2001/0036411 A1 11/2001 Walker
2003/0075629 A1 4/2003 Lucas
2003/0192589 A1 10/2003 Jennings
2003/0215165 A1 11/2003 Hogan et al.
2003/0234264 A1 12/2003 Landau
2004/0124262 A1 7/2004 Bowman et al.
2005/0006508 A1 * 1/2005 Roberts ..... 241/243
2005/0242221 A1 11/2005 Rota
2006/0024456 A1 2/2006 O'Leary et al.
2006/0024457 A1 2/2006 O'Leary et al.
2006/0024458 A1 2/2006 O'Leary et al.
2006/0231651 A1 10/2006 Evans et al.
2007/0138211 A1 6/2007 O'Leary et al.
2008/0087751 A1 4/2008 Johnson et al.

FOREIGN PATENT DOCUMENTS

| | | |
|---|---|---|
| DE | 3240126 | 5/1984 |
| EP | 0265751 | 4/1988 |
| FR | 2350450 | 3/1979 |
| GB | 1418882 | 12/1975 |
| GB | 1574027 | 9/1980 |
| GB | 2099776 | 12/1982 |
| GB | 2124194 | 2/1984 |
| GB | 2156303 | 10/1985 |
| GB | 2212471 | 7/1989 |
| GB | 2276147 | 9/1994 |
| JP | 407088985 | 4/1995 |
| NL | 8204888 | 7/1984 |

OTHER PUBLICATIONS

U.S. Appl. No. 10/899,909—Response to Final May 12, 2009.
U.S. Appl. No. 10/899,909—Final Rejection, Mar. 20, 2009.
U.S. Appl. No. 10/899,909—Rejection Sep. 20, 2007.
U.S. Appl. No. 10/899,909—Rejection Apr. 4, 2008.
U.S. Appl. No. 10/899,909—Rejection Sep. 9, 2008.
U.S. Appl. No. 10/899,909—Response Aug. 27, 2007.
U.S. Appl. No. 10/899,909—Response Dec. 20, 2007.
U.S. Appl. No. 10/899,909—Response May 16, 2008.
U.S. Appl. No. 10/899,909—Response Jan. 7, 2009.
U.S. Appl. No. 10/899,909—Restriction Jul. 31, 2007.
U.S. Appl. No. 11/303,612—Response Jan. 14, 2009.

U.S. Appl. No. 11/303,612—Response AF Jun. 29, 2009.
U.S. Appl. No. 11/581,661—Response Jul. 17, 2008.
U.S. Appl. No. 11/581,661—Response AF Jan. 9, 2009.
U.S. Appl. No. 11/581,661—Response; RCE Feb. 25, 2009.
U.S. Appl. No. 11/024,093—3 month office action Mar. 2, 2007.
U.S. Appl. No. 11/024,093—3 month office action Jul. 12, 2007.
U.S. Appl. No. 11/024,093—3 month office action Mar. 5, 2009.
U.S. Appl. No. 11/024,093—Advisory Action Jan. 11, 2008.
U.S. Appl. No. 11/024,093—Final 3 month Oct. 24, 2007.
U.S. Appl. No. 11/024,093—RCE Jan. 22, 2008.
U.S. Appl. No. 11/024,093—Response Jan. 24, 2007.
U.S. Appl. No. 11/024,093—Response Jun. 4, 2007.
U.S. Appl. No. 11/024,093—Response Oct. 12, 2007.
U.S. Appl. No. 11/024,093—Response Dec. 20, 2007.
U.S. Appl. No. 11/024,093—Response May 28, 2009.
U.S. Appl. No. 11/024,093—Restriction Nov. 24, 2006.
U.S. Appl. No. 11/303,612—3 Month Oct. 15, 2009.
U.S. Appl. No. 11/303,612—Final 3 Month Apr. 30, 2009.
U.S. Appl. No. 11/452,554—3 Month Office Action Apr. 8, 2008.
U.S. Appl. No. 11/452,554—Advisory Action Feb. 6, 2009.
U.S. Appl. No. 11/452,554—Final 3 Month Oct. 15, 2008.
U.S. Appl. No. 11/452,554—Final 3 Month May 5, 2009.
U.S. Appl. No. 11/452,554—RCE Mar. 11, 2009.
U.S. Appl. No. 11/452,554—Response Jun. 4, 2008.
U.S. Appl. No. 11/452,554—Response After Final Jan. 14, 2009.
U.S. Appl. No. 11/581,660—3 month office action May 28, 2009.
U.S. Appl. No. 11/581,660—3 month office action May 28, 2009.
U.S. Appl. No. 11/581,661—3 Month office action Apr. 3, 2008.
U.S. Appl. No. 11/581,661—3 Month May 5, 2009.
U.S. Appl. No. 11/581,661—Advisory Action Jan. 27, 2009.
U.S. Appl. No. 11/581,661—Final 3 Month Dec. 3, 2008.
Nonaka-Yasuhiro, Japanese Trade-Journal, Article, Characteristics of Functional Chromium Plating and Its Application, , 1999.
PCT Search Report for PCT/US05/26256 dated Nov. 22, 2005.
PCT Search Report for PCT/US05/27124 dated Nov. 22, 2005.
Hearing Testimony, Case No. 09 CV 263 Division 2, Boulder County District Court, Colorado, Apr. 28, 2009, 11 pages.
Hearing Testimony, Case No. 09 CV 263 Division 2, Boulder County District Court, Colorado, Apr. 29, 2009, 14 pages.
Hearing Testimony, Case No. 09 CV 263 Division 2, Boulder County District Court, Colorado, Apr. 30, 2009, 35 pages.
Hearing Testimony, Case No. 09 CV 263, Boulder County District Court, Colorado, May 1, 2009, 18 pages.
Hearing Testimony, Case No. 09 CV 263 Division 2, Boulder County District Court, Colorado, May 4, 2009, 27 pages.
Hearing Testimony, Case No. 09 CV 263 Division 2, Boulder County District Court, Colorado, May 5, 2009, 5 pages.
Hearing Testimony, Case No. 09 CV 263 Division 2, Boulder County District Court, Colorado, May 7, 2009, 8 pages.
Hearing Testimony, Case No. 09 CV 263 Division K, Boulder County District Court, Colorado, May 7, 2009, 8 pages.
Blow-Matic 8, Abiff Manufacturing Corp., Denver, CO, www.fiberiffic.com, Copyright 2002-2004 Ark-Seal, LLC, CT0000550-CT0000552, 3 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359-CT000360, 2 pages.
Insulation Blowers—Accul 9118, Insulation Machine Corp., Springfield, MA, Copyright 2006, http://accuone.com/accul_9118.html—Apr. 4, 2009, CT0000056-CT0000057, 2 pages.
AccuOne 9400, AccuOne Industries, Inc., Copyright 1998, http://www.accu1.com/A9400.html—Jul. 13, 2004, CT0000059, 1 page.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmBH, Renningen, Germany, Mar. 18, 2009, http://www.x.floc.com/en/machines/minifant-m99.html—Apr. 6, 2009, CT0000449-CT0000451, 3 pages.
X-Floc Zellofant M95, X-Floc GmBH, Renningen, Germany, Feb. 8, 2009, http://www.x.floc.com/en/machines/zellofant-m95.html—Apr. 6, 2009, CT0000107—CT0000112, 6 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
Operator's Manual for Unisul's Mini-Matic Insulation Blowing Machine, Mfg. By UNISUL, Winter Haven, FL, Publication: RTL 100, Aug. 2003, CT0000310-CT0000322, 13 pages.
Attic Protector Blow-In Fiber Glass, Johns Manville International-Insulation Group RIG 1718, Denver, CO, www.jm.com., Aug. 2000, REV, CT0000122-CT0000124, 3 page.
The Force/3 Insulation Blower, Intec, Frederick, CO,www.inteccorp.com/Force3.htm, Apr. 14, 2009, OC002939-OX002925, 3 pages.
The Quantum insulation Blower, Intec, Frederick, CO,www.intec-corp.com/Quantum.htm, Apr. 14, 2009, OC002923-OC002931, 2 pages.
The Wasp Insulation Blower, Intec, Frederick, CO, www.inteccorp.com/Wasp.com, May 18, 2005, CT0000352-CT0000354, 3 pages.
The Force/1, Intec, Frederick, CO, , D200-0200-00, KL REV, Mar. 2004, CT000008-CT0000055, 50 pages.
Krendl #450A, Krendl Machining Company, Delphos, OH, http:///?PartNo=450A, Jul. 13, 2004, CT0000067-CT0000068, 2 pages.
Isoblow Mini, Isocell Vertriebs G.M.B.H., Neumarkt Am Wallersee, Austria, www.isocell.at/home-page/blowing-technolow/isoblow-mini.html, Apr. 4, 2009, CT0000436-CT0000438, 3 pages.
Insul/Maxx 1000, Spray Insulation Components, Oklahoma City, OK, www.sprayinsulation.com/catalog.asp, Jan. 4, 2008, CT0000606-CT0000608, 3 pages.
APSCO-Pneumatic Conveying: Dilute Phase Systems, Dense Phase Systems . . . Nov. 1, 2005.
Choose a pneumatic conveying system . . . ; Powder Bulk Engineering; Steve Grant, CSC Publishing, Dec. 2004.

* cited by examiner

LOOSEFILL BLOWING MACHINE WITH A CHUTE

RELATED APPLICATIONS

This application is a Continuation-In-Part application of U.S. patent application Ser. No. 11/141,653, filed Aug. 1, 2005, now pending, and entitled BLOWING MACHINE FOR LOOSEFILL INSULATION MATERIAL, all of which is incorporated in the present application in its entirety. Application Ser. No. 11/141,653 is a Continuation-In-Part application of U.S. patent application Ser. No. 10/899,909, filed Jul. 27, 2004, now pending, and entitled BLOWING MACHINE FOR LOOSEFILL INSULATION MATERIAL, all of which is incorporated in the present application in its entirety.

TECHNICAL FIELD

This invention relates to loosefill insulation for insulating buildings. More particularly this invention relates to distributing loosefill insulation packaged in a bag.

BACKGROUND OF THE INVENTION

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing wool, is typically compressed and packaged in bags for transport from an insulation manufacturing site to a building that is to be insulated. Typically the bags are made of polypropylene or other suitable material. During the packaging of the blowing wool, it is placed under compression for storage and transportation efficiencies. Typically, the blowing wool is packaged with a compression ratio of at least about 5:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the bag is opened and the blowing wool is allowed to expand.

It would be advantageous if blowing wool machines could be improved to make them safer and easier to use.

SUMMARY OF THE INVENTION

A machine for distributing blowing wool from a bag of compressed blowing wool includes a chute having an inlet end and an outlet end, the chute being configured to receive the bag of compressed blowing wool. A shredder is mounted at the outlet end of the chute and configured to shred and pick apart the blowing wool. A discharge mechanism distributes the blowing wool into an airstream. The chute is configured such that the minimum length of the chute from the inlet end to the outlet end is the nominal length of a person's arm.

According to this invention there is also provided a machine for distributing blowing wool from a bag of compressed blowing wool, the machine includes a chute having an inlet end and an outlet end. The chute is configured to receive the bag of compressed blowing wool. A shelf is mounted to the inlet end of the chute and includes a cutting mechanism to open the bag of blowing wool. The shelf is configured to guide the bag into the inlet end of the chute. A shredder is mounted at the outlet end of the chute and configured to shred and pick apart the blowing wool. A discharge mechanism distributes the blowing wool into an airstream.

According to this invention there is also provided a machine for distributing blowing wool from a bag of compressed blowing wool, the machine includes a chute having an inlet end and an outlet end. The chute is configured to receive the bag of compressed blowing wool. A shredder is mounted at the outlet end of the chute and includes a plurality of spaced apart cutting elements. The shredder is configured to shred and pick apart the blowing wool. A plurality of cleaning members is mounted for movement between the gaps of the spaced apart cutting elements for cleaning between the spaced apart cutting elements. A discharge mechanism distributes the blowing wool into an airstream.

Various objects and advantages of this invention will become apparent to those skilled in the art from the following detailed description of the preferred embodiment, when read in light of the accompanying drawings.

DETAILED DESCRIPTION OF THE INVENTION

Figure 1:
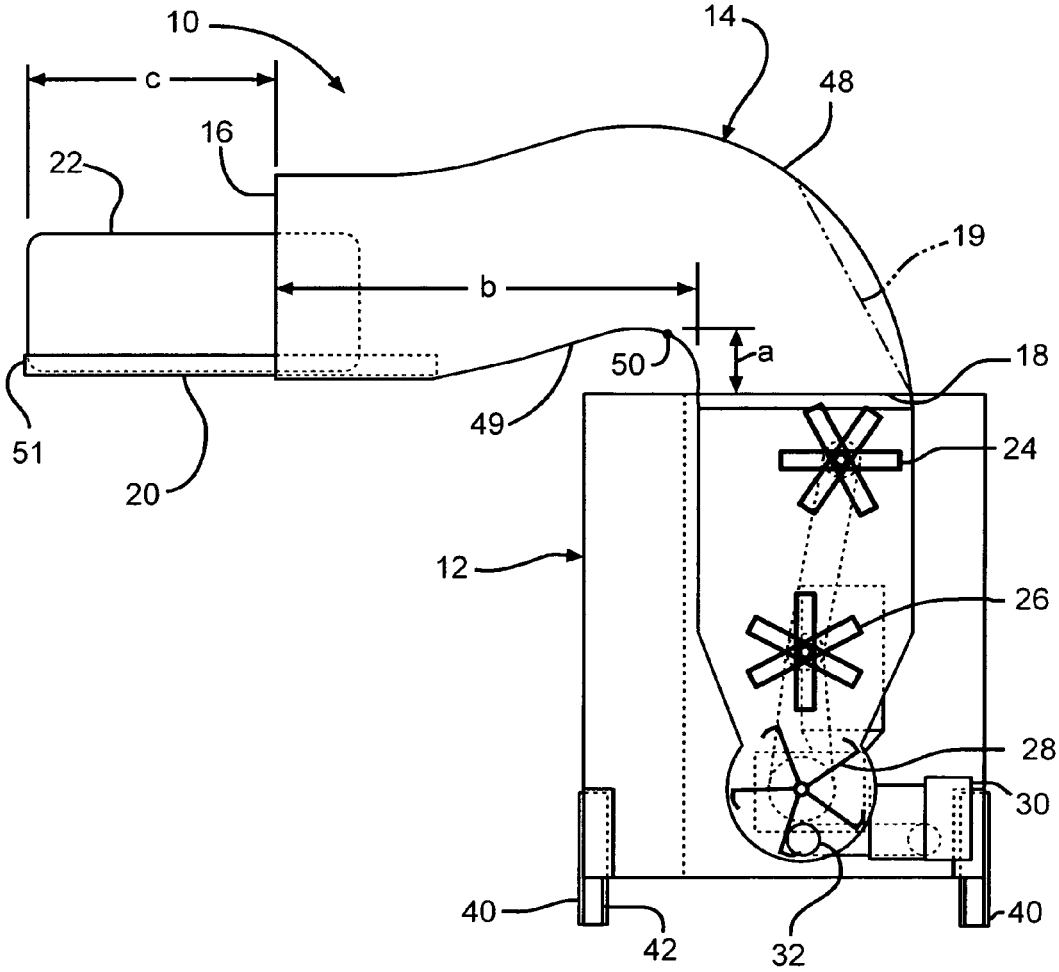
FIG. 1 is a side view in elevation, partially in cross-cross section, of an insulation blowing wool machine.
Figure 2:
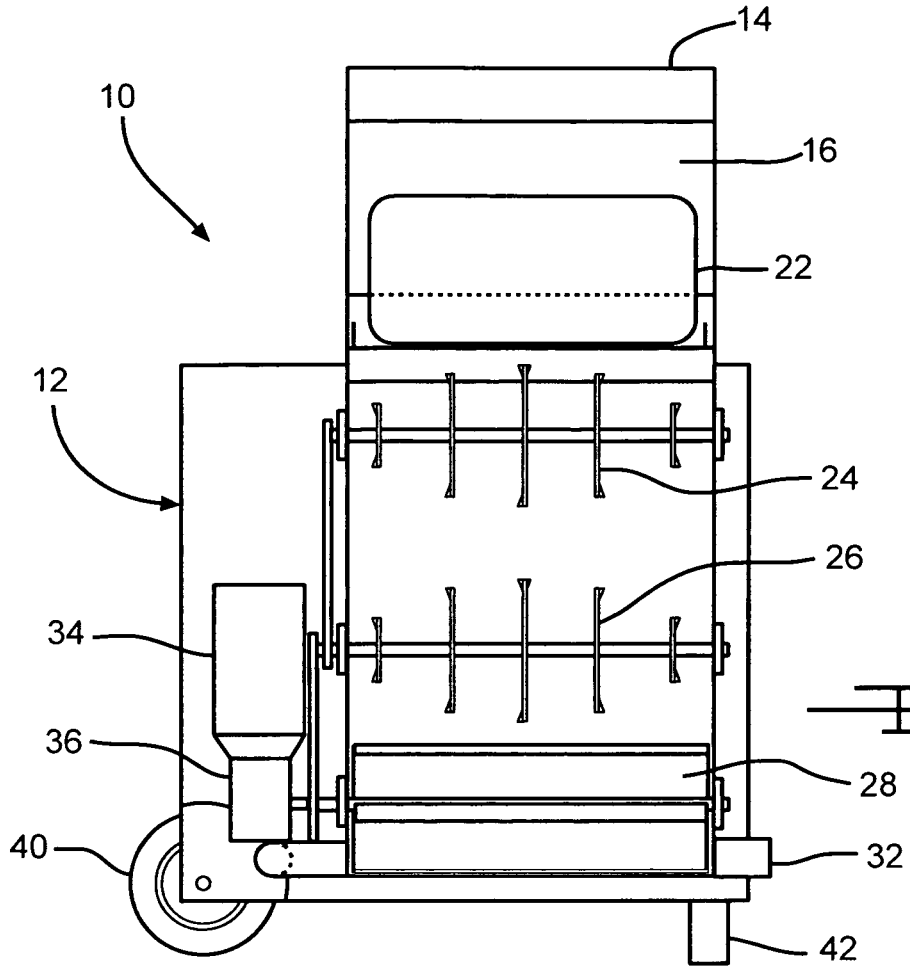
FIG. 2 is a front view in elevation, partially in cross-section, of the insulation blowing wool machine of FIG. 1.
Figure 3:
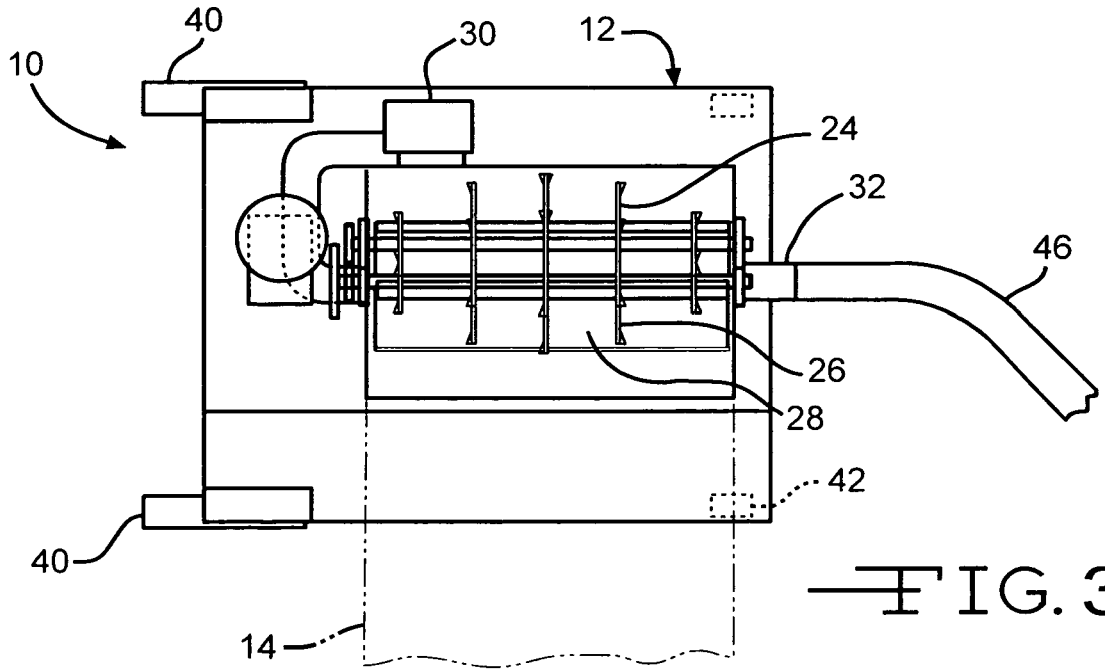
FIG. 3 is a plan view in elevation, partially in cross-section, of the insulation blowing wool machine of FIG. 1.
Figure 4:
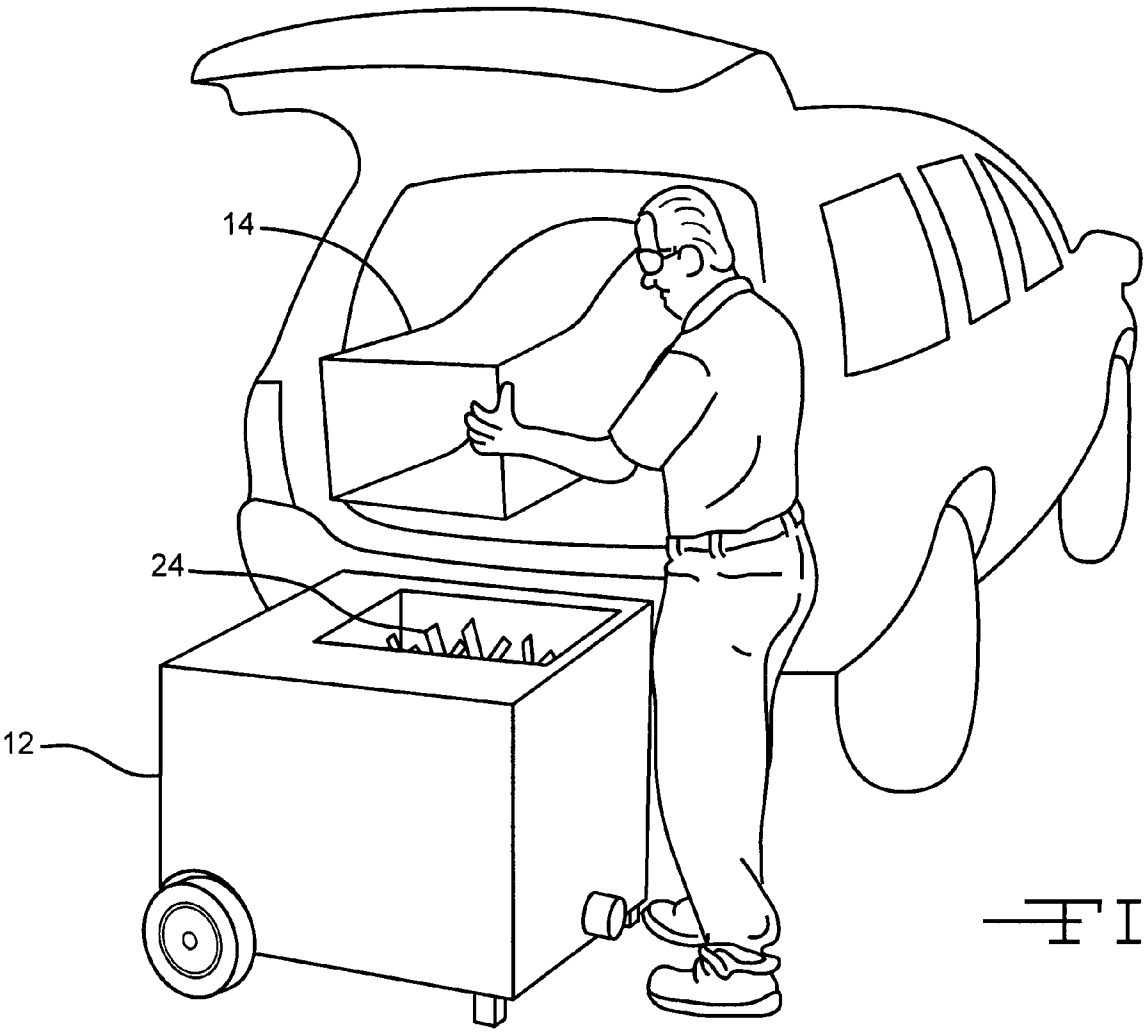
FIG. 4 illustrates the insulation blowing wool machine, separated into the lower unit and chute, which can be readily loaded into a personal vehicle.

The description and drawings disclose a blowing wool machine 10 for distributing blowing wool from a bag of compressed blowing wool. As shown in FIGS. 1-3, the blowing wool machine 10 includes a lower unit 12 and a chute 14. The lower unit 12 and the chute 14 are configured to be readily assembled and disassembled for ease of transport in a personal vehicle as shown in FIG. 4. Assembly can be accomplished by the use of fastening mechanisms, not shown, such as clamps, clips, or bolts or any other mechanism suitable to allow easy disassembly and assembly. Additionally, the lower unit 12 and the chute 14 optionally can be configured for assembly and disassembly without the use of tools or by the use of simple hand tools such as a wrench, screwdriver or socket set. As further shown in FIG. 1, the chute 14 has an inlet end 16 and an outlet end 18.

The blowing wool machine 10 also includes an optional shelf 20 which is slidably attached to the inlet end 16 of the chute 14 and configured to receive a bag 22 of compressed blowing wool. The shelf 20 guides the bag 22 of compressed blowing wool into the inlet end 16 of the chute 14. As shown in FIG. 1, the shelf 20 is a high strength plastic material, but the shelf 20 can be made of metal, wood or any other material suitable to support a bag 22 of compressed blowing and guide the bag 22 into the inlet end 16 of the chute 14. The shelf 20 is mounted to the chute 14 to allow the shelf to slide, relative to the inlet end 16 of the chute, from a retracted position, not shown, to an extended position as shown in FIG. 1. The shelf 20 is optionally provided with electrical interlocks, not shown, such that to enable operation of the blowing wool machine 10, the shelf 20 must be in the extended position. A shredder 24 is mounted in the lower unit 12 at the outlet end 18 of the chute 14 for shredding and picking apart the blowing wool as the blowing wool is discharged from the outlet end 18 of the chute 14 into the lower unit 12. In one embodiment, the shredder 24 includes a plurality of spaced apart cutting blades 91, mounted for rotation on a shredder shaft 92. Although the disclosed blowing wool machine 10 is shown with a shredder 24, any type of separator, such as a clump breaker, beater bar or any other mechanism that shreds and picks apart the blowing wool can be used. Optionally, in addition to shredding and picking apart the blowing wool, the shredder 24 can shred the sleeve, not shown, which contains or encapsulates the body of blowing wool. However, shredding of the sleeve by the shredder 24 is not necessary to the operation of the machine 10. An agitator 26 is provided for final shredding of the shredded bag and blowing wool and for preparing the blowing wool for distribution. The agitator 26 can be any means to further shred the bag and blowing wool in preparation for distribution into an airstream. A discharge mechanism 28 is positioned downstream from the agitator 26 to distribute the shredded blowing wool into an airstream. Although the discharge mechanism 28 shown in FIG. 2 is a rotary valve, any type of discharge mechanism 28, including staging hoppers, metering devices, rotary feeders, or any other mechanism sufficient to distribute the shredded blowing wool into an airstream. A blower 30 is mounted in the lower unit 12 to provide an airstream necessary to drive the shredded bag and shredded blowing wool through the discharge mechanism 28 and through the machine outlet 32. The shredder 24, agitator 26 and the discharge mechanism 28 are mounted for rotation. They can be driven by any suitable means, such as by a motor 34, a gearbox 36 and belts and pulleys 38 as best shown in FIG. 2. Alternatively, each of the shredder 24, agitator 26, and discharge mechanism 28 can be provided with its own motor. The blowing wool machine 10 is mounted on casters 40 and legs 42, which allows the machine 10 to be moved from one location to another with relative ease. However, the casters 40 and the legs 42 are optional and are not necessary to the operation of the machine 10.

In this embodiment, the chute 14 has a rectangular cross-sectional shape that approximates the cross-sectional shape of the bag 22 of compressed blowing wool. Alternatively, the chute 14 may have a round cross-sectional shape that approximates the cross-sectional shape of a package of blowing wool in roll form or any other cross-sectional shape that approximates the cross-sectional shape of the package of compressed blowing wool. As shown in FIG. 1, the chute 14 optionally includes a bag deflector 19. The bag deflector 19 mounts internally in the chute 14 and is configured to guide the bag 22 of blowing wool as the bag enters the outlet end 18 of the chute 14. As shown in FIG. 1, the bag deflector 19 is a rigid material, such as plastic, metal or wood or any other material suitable to guide the bag 22 as the bag 22 enters the outlet end 18 of the chute 14.

In general, the chute 14 guides the bag 22 of compressed blowing wool to the shredder 24 which shreds the bag and picks apart the blowing wool. The shredded bag pieces and the blowing wool drop from the shredder 24 into the agitator 26. The agitator 26 prepares the shredded bag pieces and blowing wool for distribution into an airstream by further shredding the bag pieces and blowing wool. In this embodiment of the blowing wool machine 10, the shredder 24 and the agitator 26 rotate at different speeds. The shredder 24 rotates at a generally lower speed and the agitator 26 rotates at a generally higher speed. Alternatively, the shredder 24 and the agitator 26 could rotate at substantially similar speeds. The finely shredded bag pieces and blowing wool drop from the agitator 26 into the discharge mechanism 28 for distribution into the airstream caused by the blower 30. The airstream, with the shredded bag pieces and blowing wool, exits the machine 10 at the machine outlet 32 and flows through the distribution hose 46, as shown in FIG. 3, toward the insulation cavity, not shown.

In the embodiment of the machine 10 shown in FIG. 1, the chute 14 has a curved segment 48 disposed between the inlet end 16 and the outlet end 18. Optionally, the curved segment 48 of the chute 14 includes a deflection ridge 49. The deflection ridge 49 includes a peak segment 50 which defines to highest point of the deflection ridge 49. The deflection ridge 49 functions as a safety device by preventing the machine operator from easily accessing the shredder with hands or arms. Additionally, as the bag 22 of blowing wool is driven up the slope of the deflection ridge 49 and descends past the peak segment 50, the bag 22 enters the shredder 24 at an efficient angle for shredding. The curved segment 48 of the chute 14 has both a minimum throat dimension a measured from the peak 50 of the lower raised segment 49 to the outlet end 18 of the chute 14, and a minimum length b measured from the peak segment 50 of the deflection ridge 49 to the inlet end 16 of the chute 14, which when combined are of sufficient minimum length to prevent the machine operator from placing hands and arms into the shredder 24 during operation of the machine 10. The minimum sufficient combined length of a and b is the nominal length of a person's arm, which is defined as at least about 36 inches. Optionally, the blowing wool machine 10 may include a shelf 20 in an extended position and having an inlet edge 51, as shown in FIG. 1. The shelf 20, in the extended position, has a minimum dimension c as measured from the inlet end 16 of the chute 48 to the inlet edge of the shelf 51. In this embodiment, the combined lengths of a, b, and c are of sufficient minimum length to prevent the machine operator from placing hands and arms into the shredder 24 during operation of the machine 10. The minimum sufficient length of a, b, and c is the nominal length of a person's arm, which is defined as at least about 36 inches. The curved segment 48 of the chute 14 also functions to dispose the inlet end 16 of the chute 14 to a comfortable and safe working height for the machine 10 operator.

The blowing wool in the bag 22 of compressed blowing wool can be any loosefill insulation, such as a multiplicity of discrete, individual tuffs, cubes, flakes, or nodules. The blowing wool can be made of glass fibers or other mineral fibers, and can also be organic fibers or cellulose fibers. The blowing wool can have a binder material applied to it, or it can be binderless. The blowing wool in the bag 22 is typically compressed to a compression ratio of at least 10:1, which means that the unconstrained blowing wool after the bag 22 is opened has a volume of 10 times that of the compressed blowing wool in the bag 22. Other compression ratios higher or lower than 10:1 can be used. In one embodiment, the bag 22 has approximate dimensions of about 9 inches high, about 19 inches wide and about 21 inches long, and weighs approximately 13 pounds. A typical chute 14 for such a bag 22 will have a cross-section of approximately 10 inches high by about 20 inches wide. The bag itself is typically made of a polymeric material, such as polyethylene, although any type of material suitable for maintaining the blowing wool in the desired compression can be used. Preferably, the bag 22 will provide a waterproof barrier against water, dirt and other deleterious effects. By using a polymeric material for the bag 22, the compressed blowing wool will be protected from the elements during transportation and storage of the bag 22. The preferred bag material is sufficiently robust to handle the physical abuse to which these bags are frequently subjected.

Figure 5:
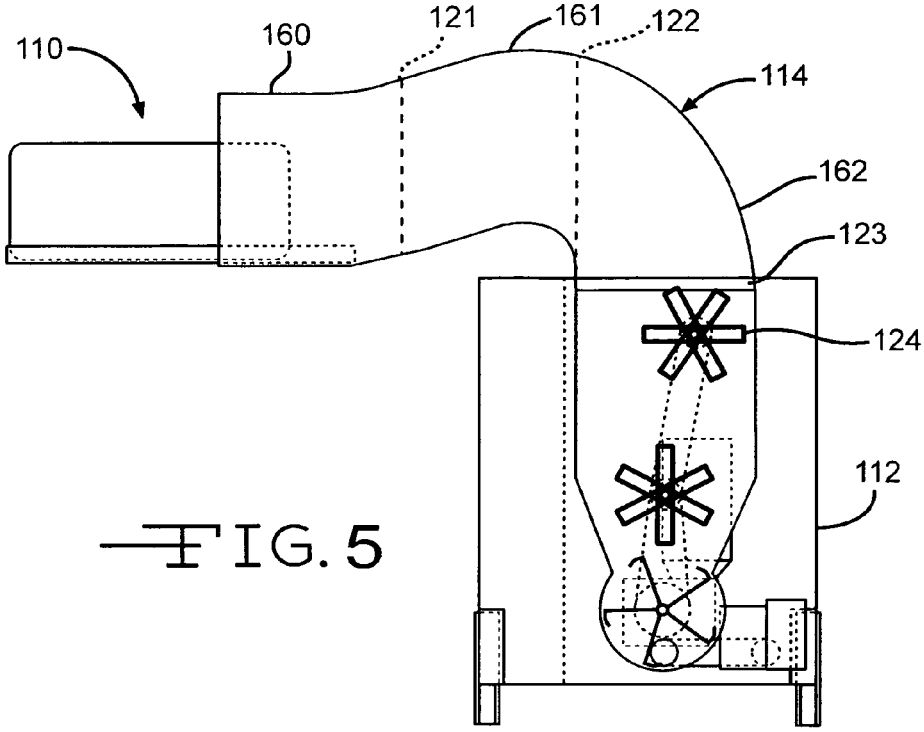
FIG. 5 is a side view in elevation, partially in cross-section, of an insulation blowing wool machine comprising a collapsible folding chute in an extended and locked position.
Figure 6:
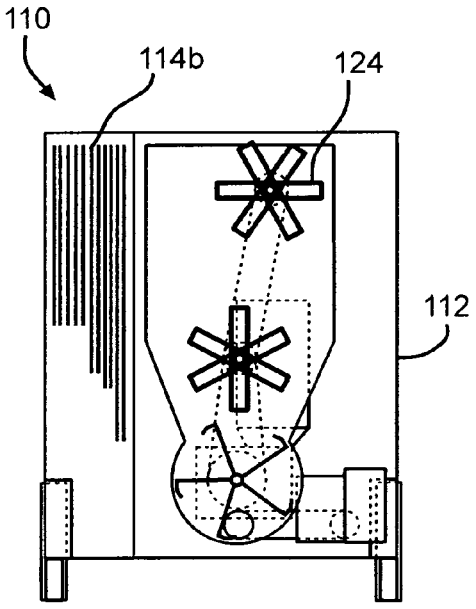
FIG. 6 is a side view in elevation, partially in cross-section, of an insulation blowing wool machine having a collapsible folding chute in the collapsed position and stored within the base unit of the insulation blowing wool machine.
Figure 7:
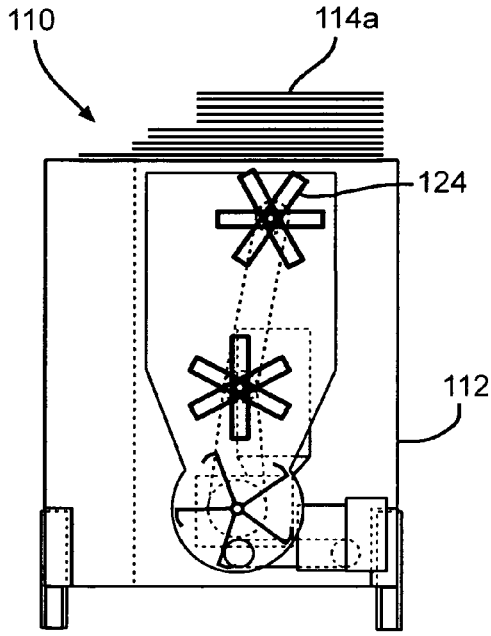
FIG. 7 is a side view in elevation, partially in cross-section, of an insulation blowing wool machine having a collapsible folding chute in the collapsed position.

As shown in FIG. 5, in a particular embodiment of the blowing wool machine 110, the machine 110 is provided with a foldable style collapsible chute 114, in an extended position. The foldable style collapsible chute 114 comprises a plurality of foldable segments 160-162 as shown in FIG. 5 in the unfolded and locked position. The foldable segments 160-162 can be formed from any material, such as metal, wood, plastic or fiberglass, suitable to form the chute to receive the blowing wool and introduce the blowing wool to the shredder 124. The material for the foldable segments 160-162 can be lightweight for ease of extension and transport. The foldable segments 160-162 are hinged at the segment edges 121-122. Foldable segment 162 is connected at segment edge 123 by a connecting mechanism, not shown, such as clips, rods or cotterpins, or any other mechanism suitable to connect and disconnect the foldable segment 162. For ease of storage and transportation, upon completion of the distribution of the blowing wool, the foldable style collapsible chute 114 can be folded to its collapsed position 114*a*, as shown in FIG. 7. The foldable segments 160-162 can be configured or shaped in order that when the foldable style chute 114 is retracted, the foldable segments 160-162 fold in a flat position. The foldable style collapsible chute 114 can be locked to fix the foldable style chute 114 in the unfolded position by a locking mechanism, not shown, such as a cotterpin or any other mechanism suitable to fix the foldable segments 160-162 in the unfolded position. Alternatively, the foldable segments 160-162 can be configured or shaped in order that the foldable style chute 114 can be retracted in a flat position and can be removed from the lower unit 112. The folded segments 160-162 can be placed in a stored position 114*b* within the lower unit as shown in FIG. 6.

Figure 8:
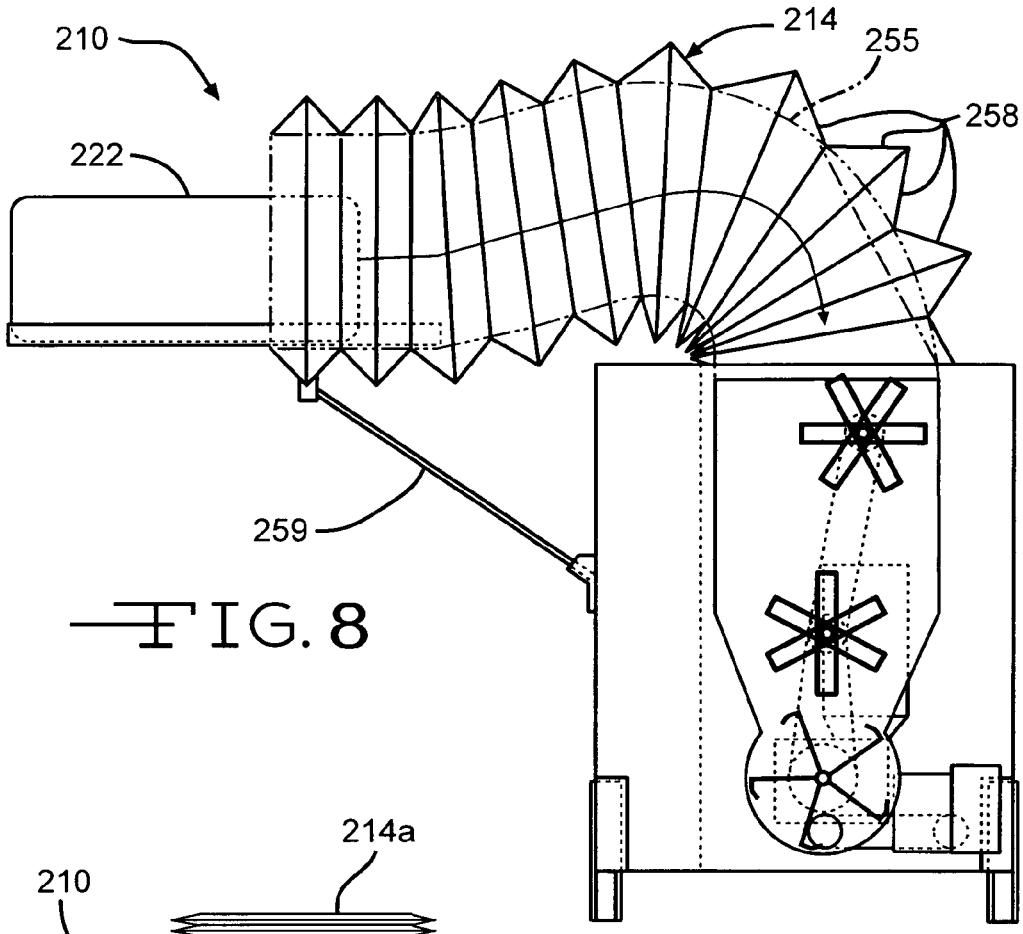
FIG. 8 is a side view in elevation, partially in cross-section, of an insulation blowing wool machine having a bellows style collapsible chute in the extended and locked position.
Figure 9:
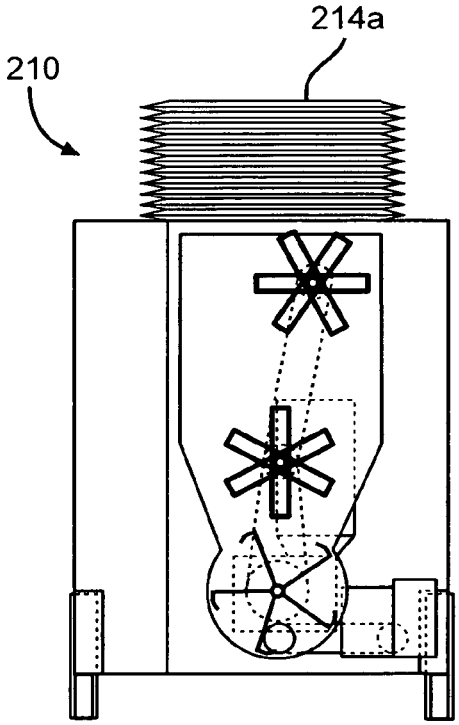
FIG. 9 is a side view in elevation, partially in cross-section, of an insulation blowing wool machine having a bellows style collapsible chute in the collapsed position.

Alternatively, the chute can be a bellows style collapsible chute 214 as shown in FIG. 8 in an extended position. The bellows style chute 214 is then locked in the fully extended position as shown in FIG. 8. Upon completion of the distribution of the picked apart blowing wool, the bellows style collapsible chute 214 can be retracted to its collapsed position 214*a*, as shown in FIG. 9. As shown in FIG. 8, the bellows style-collapsible chute 214 comprises a plurality of folded sections 258, which fold flat in the retracted position 214*a*. The folded sections 258 can be made out of any material suitable to receive the blowing wool and introduce the blowing wool to the shredder 224 such as heavy canvas, plastic, or nylon. The folded sections 258 can be configured or shaped so that when the bellows style collapsible chute 214 is retracted, the folded sections 258 fold in a flat position. The folded sections 258 can be connected by hinging or linking in any manner suitable to allow the bellows style collapsible chute 214 to retract. The bellows style collapsible chute 214 can be provided with a locking mechanism, such as a rod 259 as shown in FIG. 8 or any other suitable mechanism for fixing the bellows style collapsible chute 214 in the extended position. Optionally, a liner 255 may be disposed within the bellows style collapsible chute 214 and configured to provide smooth transition for the bag 222 of compressed blowing wool as it traverses across the sections 258. The liner 255 may be any material, such as plastic, nylon, canvas or any other material that assists in a smooth transition for the bags 222 of compressed blowing wool. The liner 255 may be connected or linked to the bellow sections 255 in any manner suitable to allow the liner to extend and retract with the bellows style collapsible chute 214.

Figure 10:
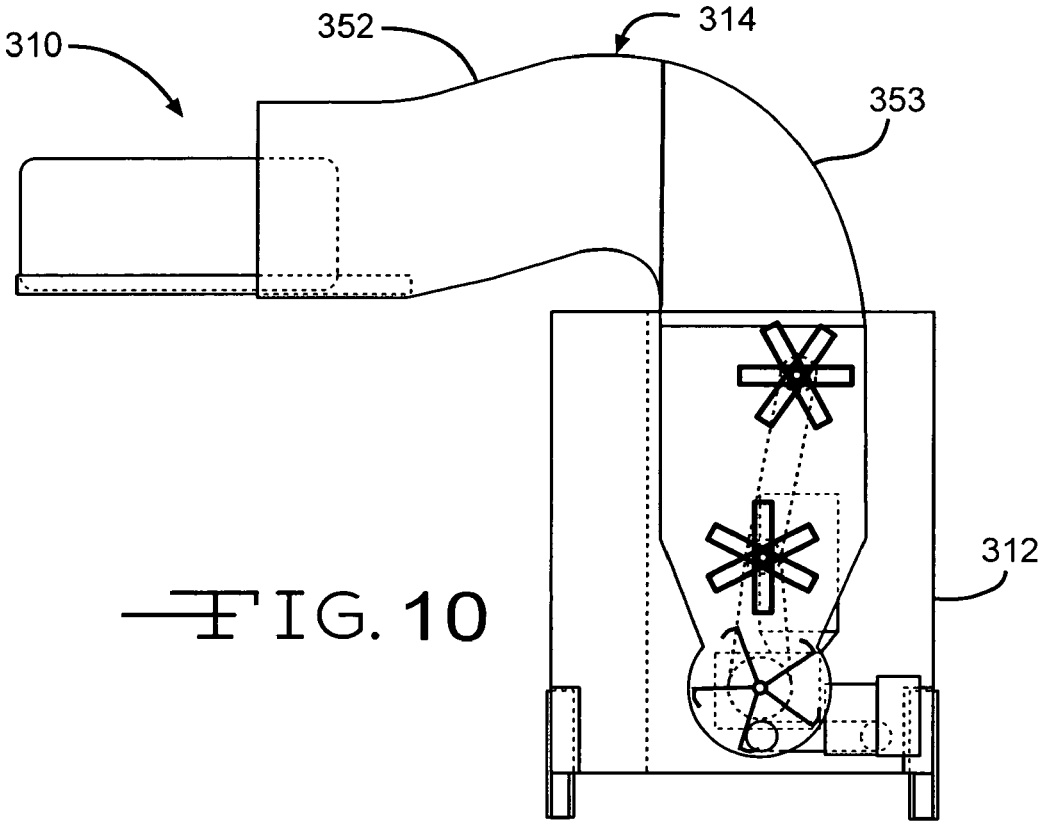
FIG. 10 is a side view in elevation, partially in cross-section, of an insulation blowing wool machine having a multiple segment chute in the extended and locked position.
Figure 10A:
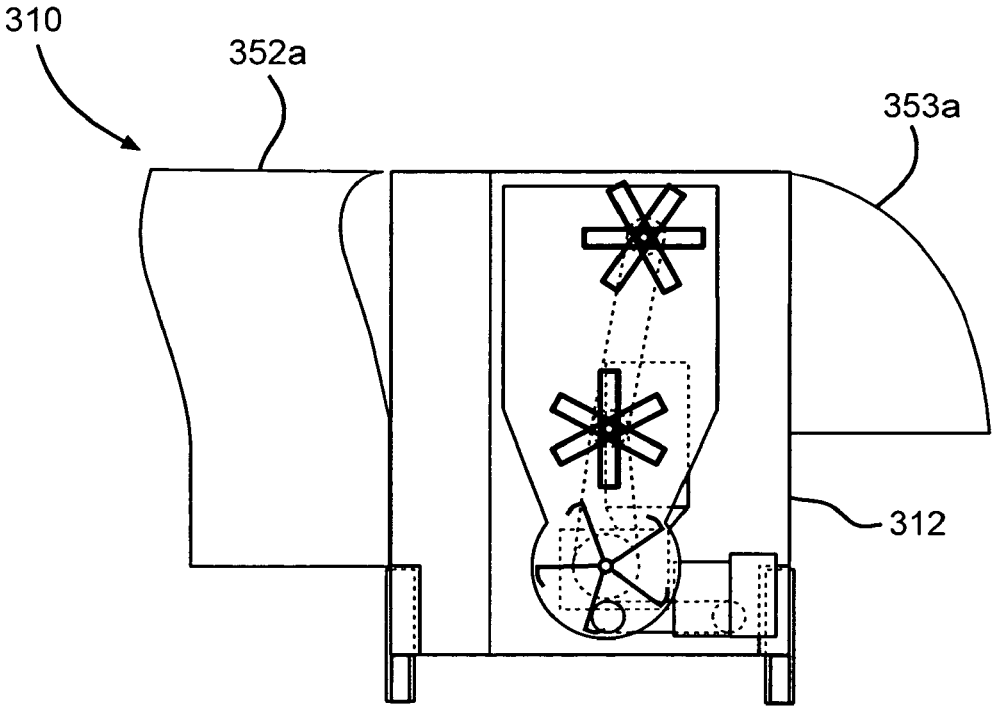
FIG. 10A is a side view in elevation, partially in cross-section, of an insulation blowing wool machine having a multiple segment chute in the disassembled and stored position.
Figure 11:
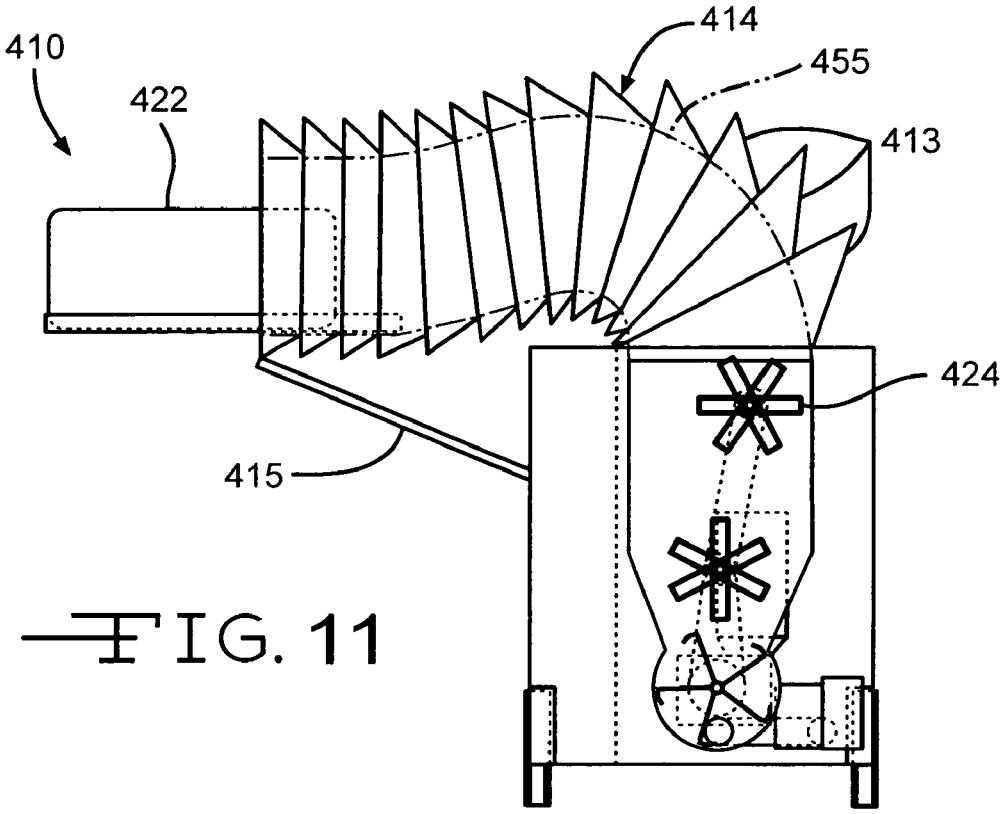
FIG. 11 is a side view in elevation, partially in cross-section, of an insulation blowing wool machine having a telescoping style collapsible chute in the extended and locked position.

In another embodiment of the blowing wool machine 310, a chute 314 comprises segments that can be readily disassembled and removed for ease of storage and transport. As shown in FIGS. 10-11, the chute 314 comprises an inlet segment 352 and an outlet segment 353. The inlet segment 352 and the outlet segment 353 are easily disassembled and separated from each other and from the lower unit 312 by the use of fastening mechanisms, not shown, such as a clamps, clips or bolts or any other mechanism suitable to allow easy removal and replacement of the inlet segment 352 and the outlet segment 353. Once the inlet segment 352 and the outlet segment 353 are removed from the lower unit 312, they are disposed in storage positions, 352*a* and 353*a*, at the sides of the lower unit 312. The inlet segment 352 and outlet segment 353 can be disassembled, removed, and replaced without the use of tools or by using simple tools such as a wrench, screwdriver or socket set.

Figure 11A:
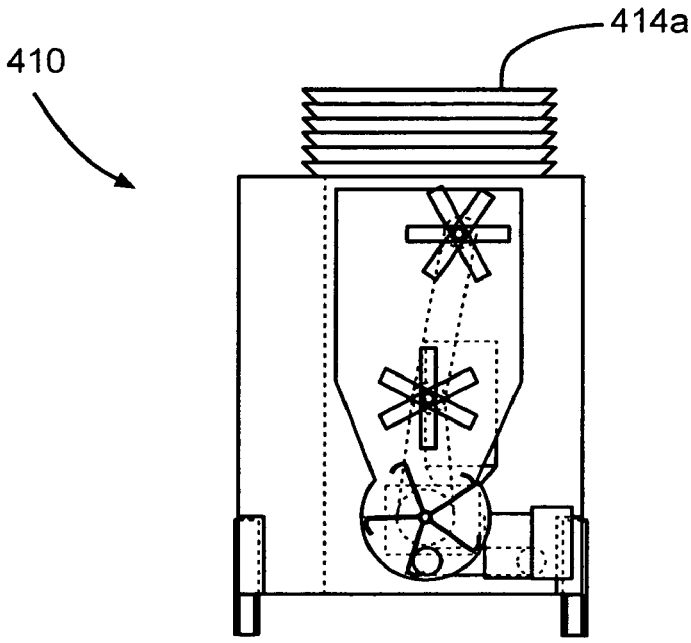
FIG. 11A is a plan view in elevation, partially in cross-section, of an insulation blowing wool machine having a telescoping style collapsible chute in the collapsed position.

In another embodiment, a blowing wool machine 410 is provided with an optional collapsible chute 414 configured to receive the bag 422 of blowing wool. When the blowing wool machine 410 is used, the collapsible chute 414 extends in a telescoping fashion to a fully extended position. The collapsible chute 414 is then locked in the fully extended position as shown in FIG. 11. Upon completion of the distribution of the picked apart blowing wool, the collapsible chute 414 can be retracted to its collapsed position 414*a*, as shown in FIG. 11A. As shown in FIG. 11, the collapsible chute 414 comprises a plurality of segments 413, which collapse in a retracted position. The segments 413 can be made out of any material suitable to receive the blowing wool and introduce the blowing wool to the shredder 424, such as metal, wood, and rigid plastic. The material for the segments 413 can be lightweight for ease of extension and transport. The segments 413 can be configured or shaped so that when the collapsible chute 414 is retracted, the segments 413 nest. The segments 413 are connected by means such as by hinging or linking in any suitable manner to allow the collapsible chute 414 to collapse. The collapsible chute 414 can be provided with a locking mechanism 415, such as a rod as shown in FIG. 11 or any other suitable mechanism for fixing the collapsible chute 414 in the extended position. Optionally, a liner 455 may be disposed within the telescoping style collapsible chute 414 and configured to provide smooth transition for the bag 422 of compressed blowing wool as the bag 422 traverses across the segments 413. The liner 455 may be any material, such as plastic, nylon, canvas or any other material that assists in a smooth transition for the bags 422 of compressed blowing wool. The liner 455 may be connected or linked to the segments 413 in any manner suitable to allow the liner 455 to extend and retract with the telescoping style collapsible chute 414.

In yet another embodiment of the blowing wool machine 10, as shown in FIG. 4, the chute 14 is readily removable and replaceable for ease of storage and transport in a typical sport utility vehicle. The chute 14 comprises a one piece segment and can be any material, such as metal, plastic, or fiberglass, suitable to receive the blowing wool and introduce the blowing wool to the shredder 24. The chute 14 can be lightweight for ease of removal and transport. As shown in FIG. 4, the chute 14 is easily removable and replaceable by the use of a fastening mechanism, not shown, such as a clamp, clip or bolts or any other mechanism to allow easy removal and replacement of the chute 12. The chute 12 can be easily removed and replaced without the use of tools or by using simple tools such as a wrench, screwdriver or socket set.

Figure 12:
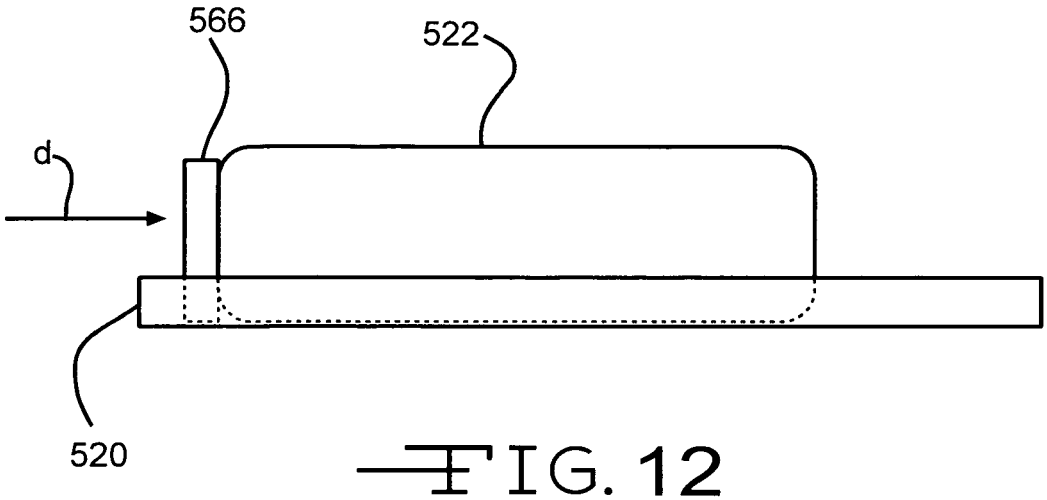
FIG. 12 is a side view in elevation of a shelf and ram member for the insulation blowing wool machine.

In another embodiment of the blowing wool machine, as shown in FIG. 12, a shelf 520 includes a ram member 566. The ram member 566, as actuated by the machine operator, is configured to contact the bag 522 of compressed blowing wool and drive the bag 522 of blowing wool through the chute, not shown, in direction d. In this embodiment, the ram member 566 is a solid plate, but the ram member can be a frame, a mesh framework, a framework including structural projections or any other device suitable for contacting and driving the blowing wool through the chute. The ram member 566 can be any material, including wood, plastic, metal or any other material suitable for contacting and driving the bag 522 of compressed blowing wool through the chute, not shown.

Figure 13:
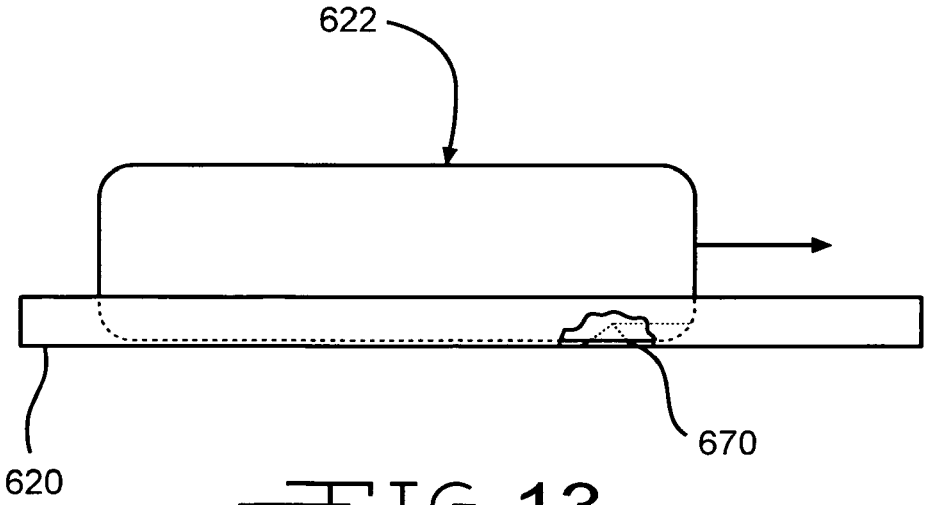
FIG. 13 is a side view in elevation of the shelf for the insulation blowing wool machine including a means to open the bag of blowing wool.

In another embodiment of the blowing wool machine as shown in FIG. 13, a shelf 620 includes a cutting mechanism 670. The cutting mechanism 670 is configured to open the bag 622 of compressed blowing wool as the bag 622 moves relative to the shelf 620 toward the chute, not shown. In this embodiment, the cutting mechanism 670 is a knife edge configured to cut the bag 622 of compressed blowing wool. Alternatively, the cutting mechanism 622 could be a hot wire, not shown, configured to open the bag 622 by melting a tear seam in the bag 622 of blowing wool, a laser, a saw toothed member, or any other mechanism suitable to open the bag 622 of compressed blowing wool as the bag 622 moves relative to the shelf 620 toward the chute, not shown.

Figure 14:
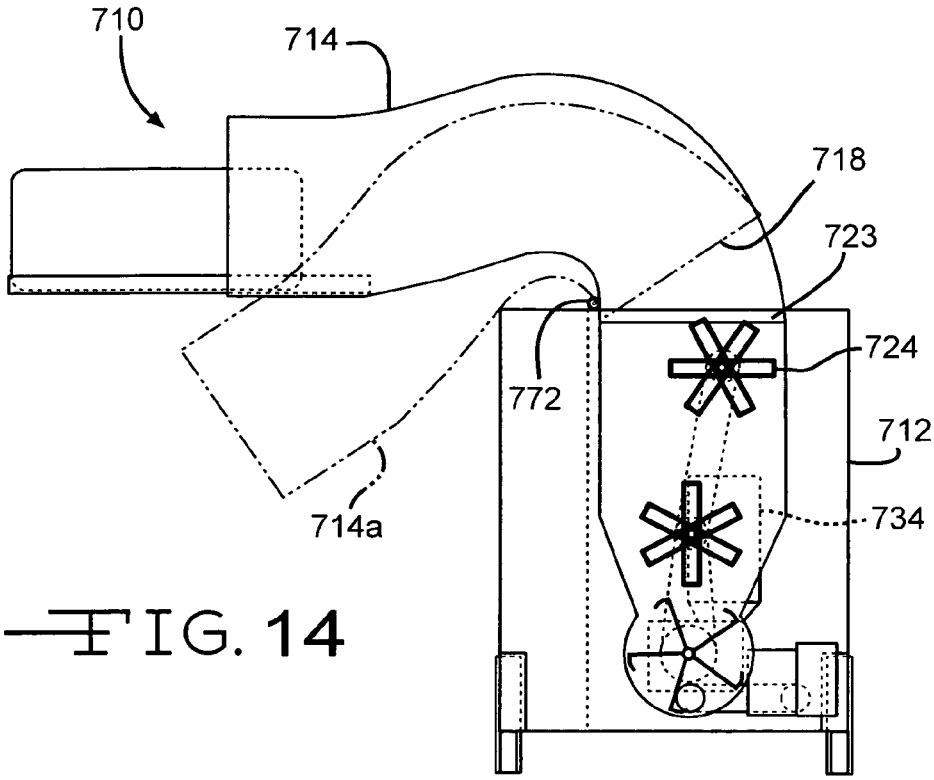
FIG. 14 is a side view in elevation, partially in cross-section, of an insulation blowing wool machine having a chute which pivots to allow access to the base unit and the outlet end of the chute.

In another embodiment of the blowing wool machine 710, as shown in FIG. 14, a chute 714 comprises a one piece segment which is configured to pivot about a chute pivot axis 772 into an open chute position 714*a*. In the open chute position 714*a*, the operator of the machine has ready access to the shredder 724, to the outlet end 718 of the chute 714, and to the inlet end 723 of the lower unit 712 for inspection, cleaning, maintenance or any other service or safety requirement. To ensure the safety of the operator, the chute 714 is provided with a plurality of electrical interlocks, not shown, configured to disconnect power to the lower unit 712 such that the motor 734 cannot run while the chute 714 is in the open chute position 714*a*. Upon return of the chute 714 to its normal operating position, the plurality of electrical interlocks reestablish electrical power to the lower unit 712 and the motor 734 such that the motor 734 can operate. The chute 714 can be any material, such as metal, plastic, or fiberglass, suitable to receive the blowing wool and introduce the blowing wool to the shredder 724. As shown in FIG. 14, the chute 714 easily fastens to the lower unit 712 by the use of a fastening mechanism, not shown, such as a clamp, clip or bolts or any other mechanism to allow easy fastening or unfastening of the chute 714. The chute 714 can be easily fastened and unfastened without the use of tools or by using simple tools such as a wrench, screwdriver or socket set.

Figure 15:
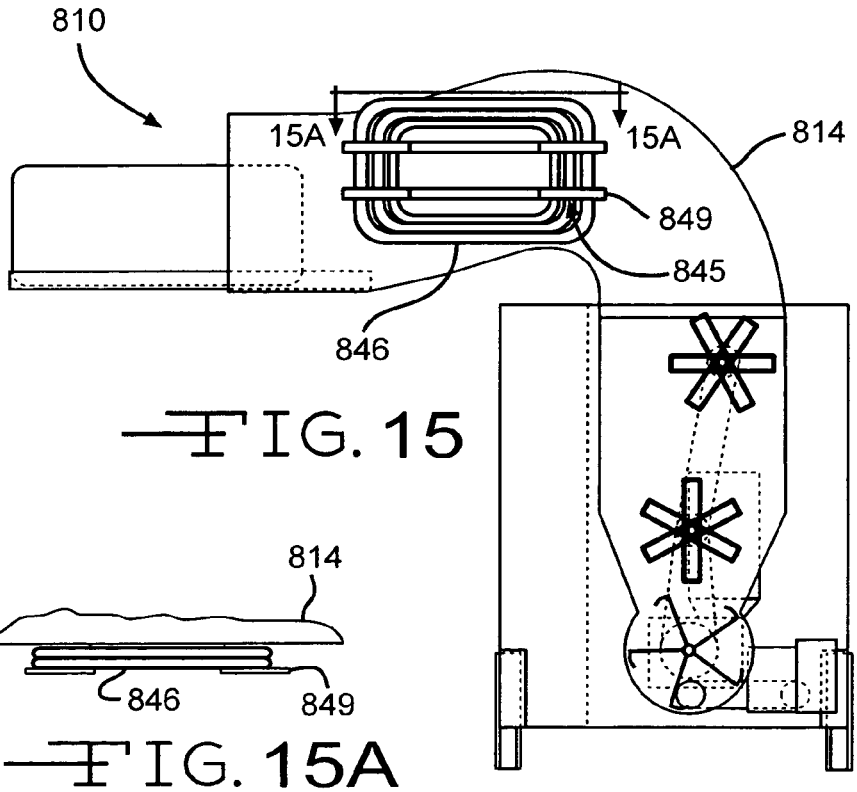
FIG. 15 is a side view in elevation, partially in cross-section, of an insulation blowing wool machine having an optional fixture, mounted to the chute, for storing the distribution hose.
Figure 15A:
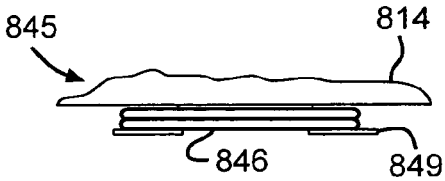
FIG. 15A is a plan view in elevation of the optional fixture for storing the distribution hose.

In another embodiment of the blowing wool machine 810, as shown in FIG. 15, a chute 814 includes a hose fixture 845 mounted to the exterior of the chute 814. In this embodiment, the hose fixture 845 comprises a plurality of rigid hose straps 849 as shown in FIG. 15A, each mounted to the exterior of the chute 814 and configured to provide a form about which the distribution hose 846 may be wrapped for ease of storage and transport. Alternatively, the hose fixture 845 could comprise a mesh frame, a circular structure or any other means to provide a support in which the distribution hose 846 may be wrapped.

Figure 16:
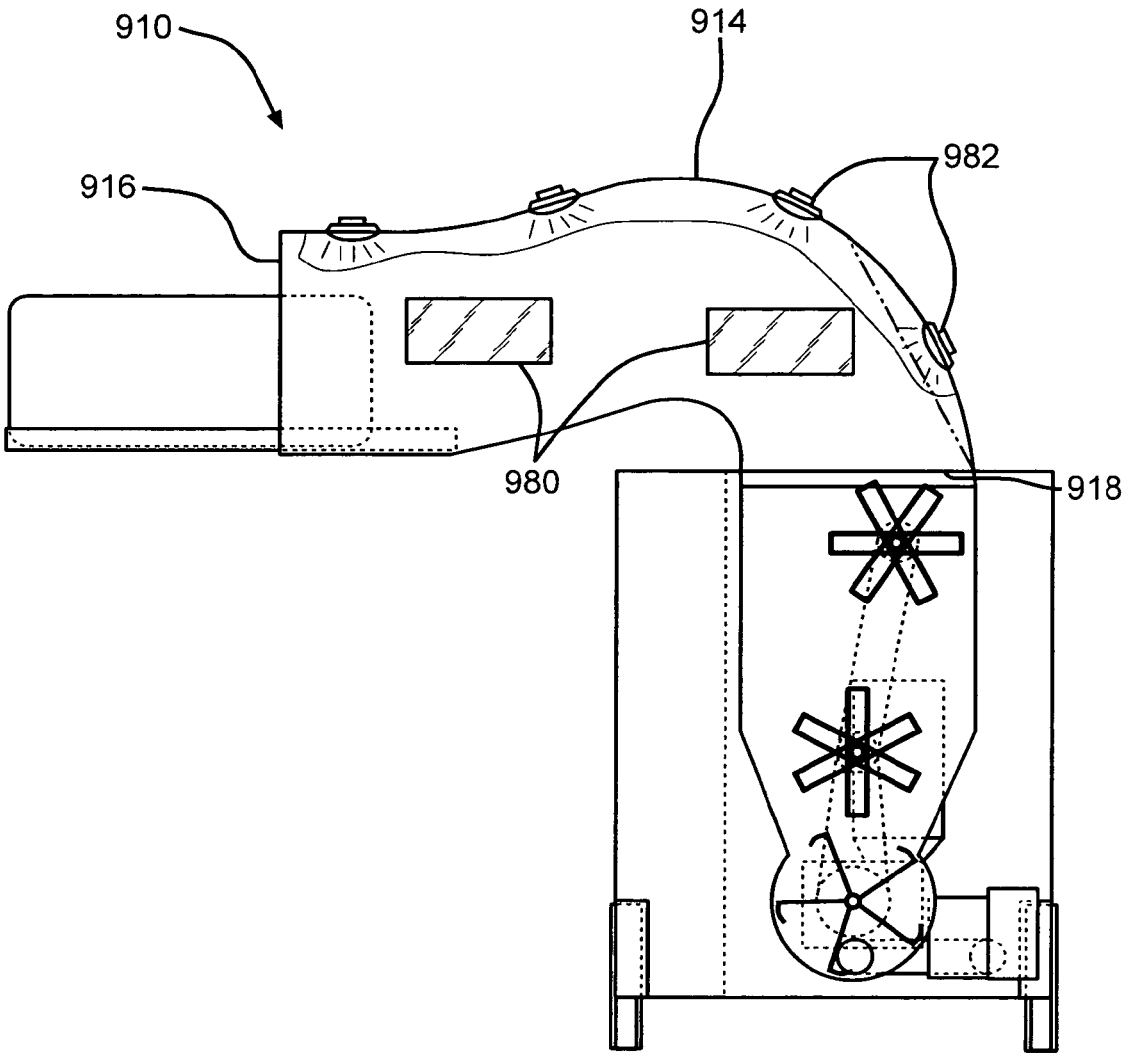
FIG. 16 is a side view in elevation, partially in cross-section, of an insulation blowing wool machine having optional viewing ports and optional illumination lights.

In another embodiment of the blowing wool machine 910, as shown in FIG. 16, a chute 914 includes a plurality of viewing ports 980 and a plurality of chute lights 982 configured to allow visual inspection of the interior of the chute 914. In this embodiment, the viewing ports 980 comprise a clear plastic window, of generally rectangular shape, mounted to the chute 914 such that the operator can easily see inside the chute 914. Alternatively, the viewing ports 980 could be any material, shape or configuration that allows the operator to see through to the interior of the chute 914. Additionally, this embodiment of the blowing wool machine 910 includes a plurality of chute lights 982 mounted in the chute 914 at convenient intervals along the length of the chute 914. The chute lights 982 comprise a low voltage illumination means configured to light the interior of the chute 914. Alternatively, the chute lights 982 could be mounted at the inlet end 916 of the chute 914 with the resulting illumination trained toward the outlet end 918 of the chute 914 or any other means of lighting the interior of the chute 914 sufficient to allow visual inspection through the viewing ports 980.

Figure 17:
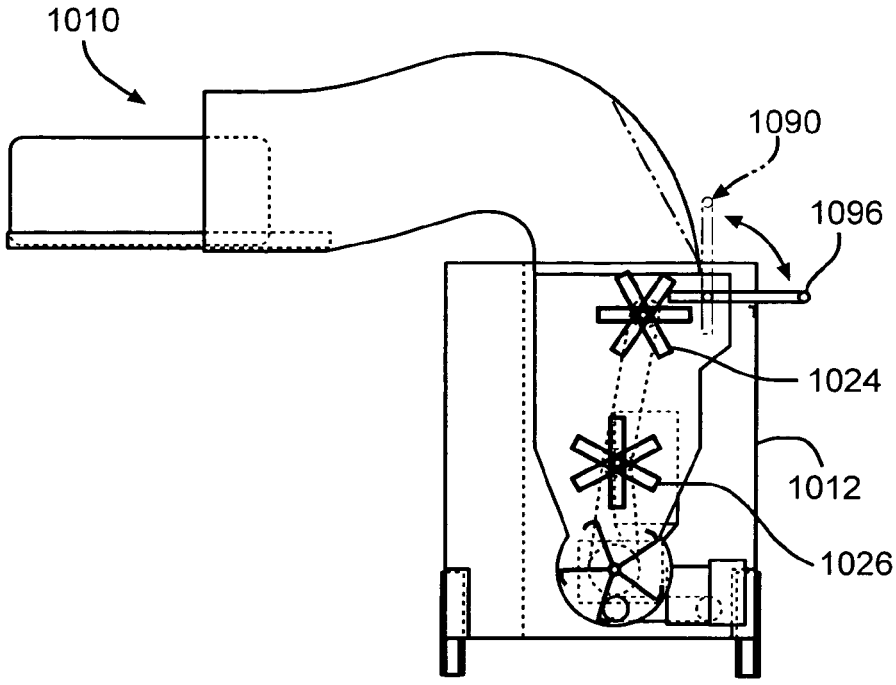
FIG. 17 is a side view in elevation, partially in cross-section, of an insulation blowing wool machine having an optional pivoting blockage bar mechanism.
Figure 18:
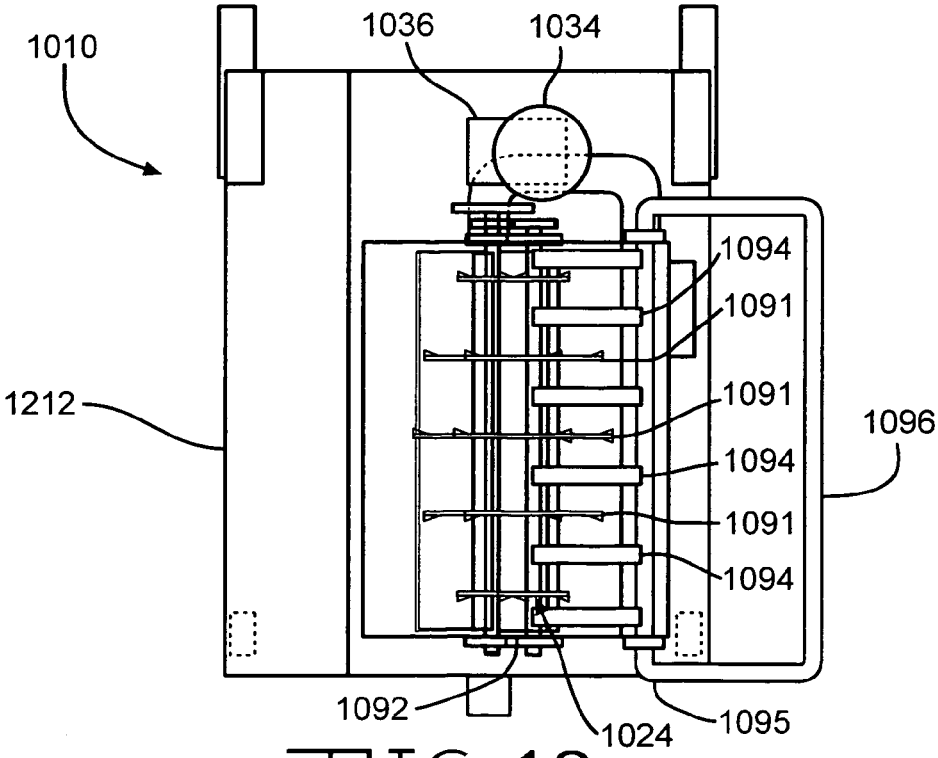
FIG. 18 is a plan view in elevation, partially in cross-section, of the insulation blowing wool machine of FIG. 1 having an optional pivoting blockage bar mechanism.

In yet another embodiment, the blowing wool machine 1010, as shown in FIGS. 17 and 18, includes a lower unit 1012 with a blockage bar mechanism 1090 configured to dislodge blockages in the shredder 1024 caused by lodged pieces of the shredded bag and pieces of compressed blowing wool. As best shown in FIG. 18, the shredder 1024 comprises a plurality of spaced apart cutting elements 1091 configured to shred the bag and pick apart the blowing wool. The spaced apart cutting elements 1091 are mounted to a shredder shaft 1092 and configured to rotate as driven by the motor 1034, gearbox 1036 and belts and pulleys, not shown. The spaced apart cutting elements 1091 can be any suitable member for shredding the bag and picking apart or loosening the highly compressed blowing wool. A plurality of cleaning members 1094, interspersed between the gaps of the spaced apart cutting elements 1091, is connected to a blockage bar shaft 1095. The blockage bar shaft 1095 is mounted to the base unit 1012 such that the blockage bar shaft 1095 can rotate allowing the cleaning members 1094 to move within the spaced apart cutting elements 1091 and thereby clean between the spaced apart cutting elements 1091. A blockage bar lever 1096 is connected to the blockage bar shaft 1095 and configured to turn the blockage bar shaft 1095 as the blockage bar lever 1096 pivots vertically. In operation, the machine operator engages the blockage bar lever 1096 and moves the blockage bar lever 1096 back and forth vertically. The pivoting action of the blockage bar lever 1096 causes the blockage bar shaft 1095 to turn in a corresponding direction which causes the plurality of cleaning members 1094 to move in the same corresponding direction. The movement of the cleaning members 1094 cleans pieces of the shredded bag and blowing wool from the spaced apart cutting elements 1091. While the cleaning members 1094 are shown as a solid member, the cleaning members 1094 can be any shape or form, including a frame, a mesh framework, a multiplicity of members, and a framework including structural projections or any other device suitable for cleaning between the spaced apart cutting elements 1091. While the blockage bar mechanism 1090 shown in FIGS. 17 and 18 operates on the shredder 1024, it should be understood that the blockage bar mechanism 1090 may also be applied to the agitator 1026 in the same manner.

Figure 19:
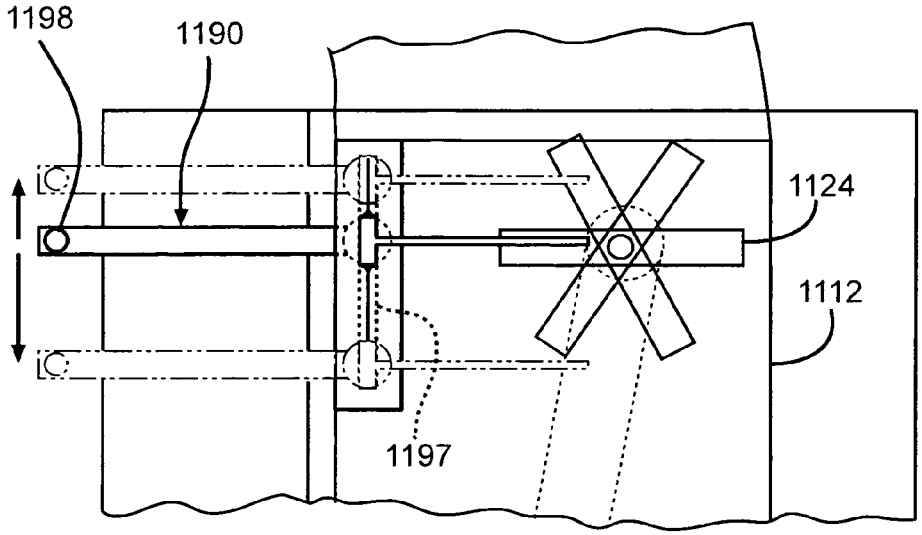
FIG. 19 is a side view in elevation, partially in cross-section, of an insulation blowing wool machine having another embodiment of the blockage bar mechanism.
Figure 20:
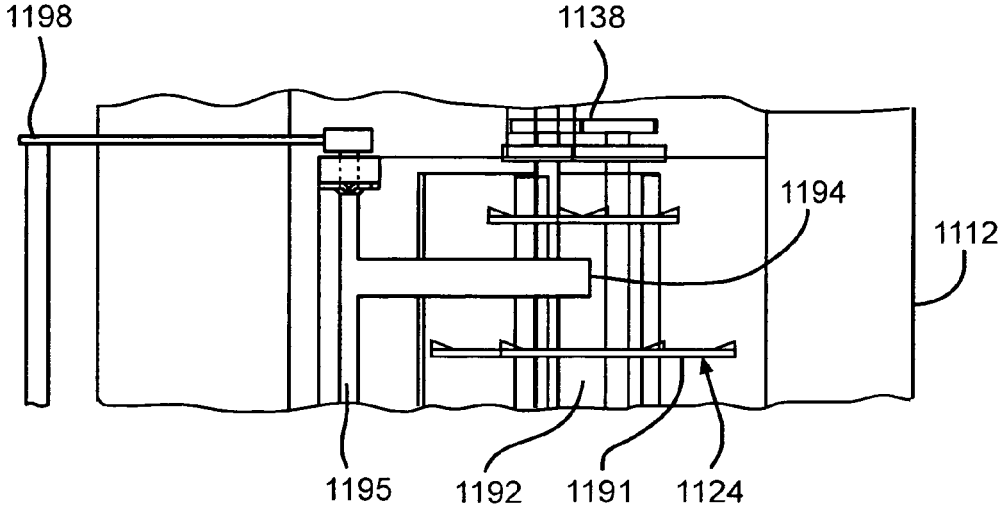
FIG. 20 is a plan view in elevation, partially in cross-section, of the insulation blowing wool machine of FIG. 20 having an optional blockage bar mechanism.

In yet another embodiment of the blowing wool machine, as shown in FIGS. 19 and 20, a lower unit 1112 comprises a blockage bar mechanism 1190 configured to dislodge blockages in the shredder 1124 caused by lodged pieces of the bag and pieces of compressed blowing wool. As best shown in FIG. 20, the shredder 1124 comprises a plurality of spaced apart cutting elements 1191 configured to shred the bag, not shown, and pick apart the blowing wool. The spaced apart cutting elements 1191 are mounted to the shredder shaft 1192 and configured to rotate as driven by the motor, not shown, gearbox, not shown, and belts and pulleys 1138. The spaced apart cutting elements 1191 can be any suitable member for shredding the bag and picking apart or loosening the highly compressed blowing wool. A plurality of cleaning members 1194, interspersed between the spaced apart cutting elements 1191, is connected to a blockage bar carriage 1195. The blockage bar carriage 1195 is mounted for vertical movement within the blockage bar track 1197, as shown in FIG. 19, such that vertical movement of the blockage bar carriage 1195 along the blockage bar track causes vertical movement of the cleaning members 1194, thereby allowing the cleaning members 1194 to clean between the spaced apart cutting elements 1191. A blockage bar handle 1198 is connected to the blockage bar carriage 1195 and configured to allow the machine user to move the blockage bar carriage 1195 back and forth vertically. In operation, the machine operator engages the blockage bar handle 1198 and moves the blockage bar handle 1198 back and forth vertically. The back and forth vertical movement of the blockage bar handle 1198 causes the blockage bar carriage 1195 to move in a corresponding direction which causes the cleaning members 1194 to also move in the same corresponding direction. The movement of the cleaning members 1194 cleans lodged pieces of the shredded bag and blowing wool from the spaced apart cutting elements 1191. While the cleaning members 1194 are shown as a solid member, the cleaning members 1194 can be any shape or form, including a frame, a mesh framework, a multiplicity of cleaning members and a framework including structural projections or any other device suitable for cleaning between the spaced apart cutting elements 1191.

The principle and mode of operation of this blowing wool machine have been described in its preferred embodiments. However, it should be noted that the blowing wool machine may be practiced otherwise than as specifically illustrated and described without departing from its scope.

What is claimed is:

1. A machine for distributing blowing wool from a bag of compressed blowing wool, the machine comprising:

a chute having an inlet end, an outlet end, a top extending from the inlet end to the outlet end and having a top curved segment and a bottom extending from the inlet end to the outlet end and having a bottom curved segment, the bottom curved segment having a deflection ridge, the deflection ridge having an arcuate cross-sectional shape and including a peak segment, the deflection ridge having a slope extending upwardly to the peak segment, the slope of the deflection ridge configured to guide the blowing wool in a direction that includes an upward vertical component toward the peak segment, the chute configured to receive the bag of compressed blowing wool;

a shredder mounted at the outlet end of the chute and configured to shred and pick apart the blowing wool; and a discharge mechanism for distributing the blowing wool into an airstream;

wherein the combined minimum length from the inlet end of the chute to the peak segment and from the outlet end of the chute to the peak segment is the nominal length of a person's arm.

2. The machine of claim 1 in which the chute is a one piece segment.

3. The machine of claim 1 in which the chute is pivotally mounted to allow access to the outlet end of the chute and the shredder.

4. The machine of claim 1 in which the chute has illuminated internal viewing ports to allow the machine user to view the blowing wool passing through the chute.

5. The machine of claim 1 in which the chute is collapsible.

6. The machine of claim 5 in which the collapsible chute has a plurality of segments.

7. The machine of claim 6 in which the segments of the collapsible chute are nestable.

8. The machine of claim 6 in which the segments of the collapsible chute can be folded upon themselves.

9. The machine of claim 5 in which the collapsible chute has a bellows configuration.

10. The machine of claim 5 including a locking mechanism to fix the collapsible chute in an extended position.

11. The machine of claim 5 in which the chute is easily removable and replaceable by means of clamps, clips or bolts.

12. The machine of claim 5 in which the chute is comprised of a plurality of separable segments.

13. A machine for distributing blowing wool from a bag of compressed blowing wool, the machine comprising:

a chute having an inlet end, an outlet end, a top extending from the inlet end to the outlet end and having a top curved segment and a bottom extending from the inlet end to the outlet end and having a bottom curved segment, the bottom curved segment having a deflection ridge including a peak segment, the deflection ridge having a slope extending upwardly to the peak segment, slope of the deflection ridge configured to guide the blowing wool in a direction that includes an upward vertical component toward the peak segment, the chute configured to receive the bag of compressed blowing wool;

a shelf slidably attached to the inlet end of the chute and having a cutting mechanism to open the bag of blowing wool, the shelf being configured to slide from a retracted position to an extended position and guide the bag into the inlet end of the chute;

a shredder mounted at an outlet end of the chute and configured to shred and pick apart the blowing wool; and a discharge mechanism for distributing the blowing wool and shredded bag into an airstream.

14. The machine of claim 13 in which the shelf can be moved relative to the inlet end of the chute.

15. The machine of claim 13 in which the shelf includes an electrical interlock.

16. The machine of claim 13 in which the shelf includes a ram member configured to contact and drive the bag of compressed blowing wool through the chute.

* * * * *